US009869123B2

(12) United States Patent
Arthur

(10) Patent No.: US 9,869,123 B2
(45) **Date of Patent: *Jan. 16, 2018**

(54) ATTIC ENTRANCE INSULATION COVER

(71) Applicant: SOUTHEAST ENERGY SOLUTIONS, INC., Lynchburg, VA (US)

(72) Inventor: Michael L. Arthur, Lynchburg, VA (US)

(73) Assignee: SOUTHEAST ENERGY SOLUTIONS, INC., Lynchburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/630,375

(22) Filed: Jun. 22, 2017

(65) Prior Publication Data

US 2017/0292318 A1 Oct. 12, 2017

Related U.S. Application Data

(63) Continuation-in-part of application No. 15/337,065, filed on Oct. 28, 2016, now Pat. No. 9,695,630.

(60) Provisional application No. 62/319,886, filed on Apr. 8, 2016.

(51) Int. Cl.
*E06B 5/00* (2006.01)
*E06B 3/70* (2006.01)

(52) U.S. Cl.
CPC ..... *E06B 5/00* (2013.01); *E06B 3/7015* (2013.01)

(58) Field of Classification Search
CPC ..... E06B 5/00; E06B 3/7015
See application file for complete search history.

(56) References Cited

U.S. PATENT DOCUMENTS

| | | | | |
|---|---|---|---|---|
| 2,321,499 | A | 6/1943 | Marschke | |
| 4,312,423 | A | 1/1982 | Helbig | |
| 4,337,602 | A | 7/1982 | King | |
| 4,574,544 | A * | 3/1986 | Harris, Sr. | E04B 7/00 52/199 |
| 4,832,153 | A | 5/1989 | Daw | |
| 5,475,955 | A | 12/1995 | Dickinson | |
| 5,628,151 | A | 5/1997 | Monat | |
| RE36,975 | E | 12/2000 | Williams | |
| 6,223,490 | B1 | 5/2001 | Wessley et al. | |
| 6,578,327 | B1 | 6/2003 | Hackbarth et al. | |
| 7,650,722 | B1 | 1/2010 | Melesky | |
| 7,690,165 | B2 | 4/2010 | Taylor | |
| 8,413,393 | B2 | 4/2013 | Melesky | |
| 8,869,473 | B2 * | 10/2014 | Melesky | E04B 9/003 49/466 |
| 2004/0055819 | A1 | 3/2004 | Lynn | |

(Continued)

*Primary Examiner* — Jeanette E Chapman

(74) *Attorney, Agent, or Firm* — Charles S. Sara; DeWitt Ross & Stevens S.C.

(57) ABSTRACT

An attic-insulation cover designed to cover access doors leading into attic spaces, such as scuttle holes and vertical attic doors includes an attic insulation flange or border for placement over the attic opening frame, the attic insulation flange having a first top end and a second bottom end, an attic insulation jacket having a top wall, parallel side walls, parallel end walls and a bottom panel; and a closure device at the second bottom end of the attic-insulation flange for connecting the attic insulation flange and the attic insulation jacket.

20 Claims, 7 Drawing Sheets

(56) References Cited

U.S. PATENT DOCUMENTS

| | | | | |
|---|---|---|---|---|
| 2007/0033888 | A1* | 2/2007 | Hendricks | F24F 13/082 52/198 |
| 2009/0094908 | A1 | 4/2009 | Krueger | |
| 2009/0133342 | A1 | 5/2009 | Copeland | |
| 2010/0107510 | A1* | 5/2010 | Copeland | E06B 5/01 52/19 |

* cited by examiner

ATTIC ENTRANCE INSULATION COVER

CROSS-REFERENCE TO RELATED APPLICATIONS

The application is a continuation-in-part application to U.S. patent application entitled "ATTIC INSULATION COVER," Ser. No. 15/337,065, filed Oct. 28, 2016, which claims the benefit of priority of U.S. Provisional patent application No. 62/319,886, filed Apr. 8, 2016, both of which are incorporated herein by reference in their entirety.

FIELD OF THE INVENTION

The present invention is directed to an attic-insulation cover designed to insulate and cover scuttle hole attic entrances and access doors leading into attic spaces, such as knee wall entrance openings and vertical attic doors.

BACKGROUND

The present invention is directed to an attic-insulation cover which is primarily designed to fit over and above a scuttle hole entrance, which enters the attic from the air conditioned space of a residential house. The attic access is typically located in the hallway ceiling, but can be found in other rooms as well. It is always on the floor level of the house that meets the attic space. A scuttle hole is typically a 2 foot by 2-foot entrance opening to the attic, covered by a panel. Often, the cover panel fits poorly allowing air to pass through the scuttle hole. This can cause a problematic air leak, resulting in a significant reduction in attic insulation.

The prior art includes various types of attic-insulation covers. Examples of such devices are as follows:

U.S. Pat. No. 6,578,327 to Hackbarth et al is directed to an attic scuttle entrance cover, which includes a sleeve with a perimeter wall, and a hinged door for facilitating access to the attic from a room below.

US Publication 2009/0133342 to Copeland is directed to a scuttle hole insulated cover with a magnetic air sealing system.

U.S. Pat. No. 6,223,490 to Wessley et al is directed to a scuttle hole cover with a sleeve and insulating cap.

However, none of the prior art includes an insulation cover which provides the combined qualities of quick installation, easy access to the attic area and premier insulation.

SUMMARY OF THE INVENTION

Reference numbers related to the figures accompanying this description. The present invention is directed to an attic-insulation cover 10 designed to cover an attic-access opening 24 leading into attic spaces 30, such as scuttle holes and vertical attic doors. The idea here is to create an attic insulator that fits over and above a scuttle hole opening or the like which enters the attic from a conditioned space of a residential house.

More particularly, the present invention is directed to an attic-insulation cover for insulating an opening in a ceiling, wherein the opening includes an attic-opening frame having spaced side walls and spaced end walls and a removable cover panel, the attic-insulation cover comprising: an attic insulation flange adapted to be secured to the attic-opening frame; a panel pocket adapted to temporarily receive the removable cover panel, wherein the panel pocket comprises parallel sidewalls and an upper panel to form a recessed area for receiving the removable cover panel, wherein the panel pocket is removably secured to the attic insulation flange, an attic-insulation chamber, wherein the attic-insulation chamber is secured to the panel pocket, wherein the attic-insulation chamber comprises a bottom panel and a top panel, parallel sidewall panels and parallel ends, wherein one end is open and at least one end is adapted to be removably closed, thereby forming an interior chamber; and a closure device for removably securing the attic-insulation flange to the panel pocket.

The present invention is further directed to a door-insulation cover, for insulating a door opening, wherein the opening includes a door frame having spaced side walls and spaced end walls and a door, the door-insulation cover comprising: a door insulation flange adapted to be secured to the door frame; a door-insulation jacket, wherein the door-insulation jacket is removably secured to the door-insulation flange, wherein the door-insulation jacket comprises a first panel and a second panel, parallel sidewall panels and parallel ends, wherein one end is open and at least one end is adapted to be removably closed, thereby forming an insulation chamber; and a closure device for removably securing the door-insulation flange to the door-insulation jacket.

The present invention is further directed to a vertical door-insulation cover for insulating a vertical door opening, wherein the door opening includes a door frame having spaced side walls and spaced end walls, the door-insulation cover comprising a door insulation flange adapted to be secured to the door-opening frame, wherein the door-insulation flange has a first end and a second end, wherein the first end is defined by a closure device. The cover also includes a door-insulation jacket, wherein the door-insulation jacket is removably secured to the door-insulation flange, wherein the door-insulation jacket comprises a bottom panel and a top panel, parallel sidewall panels and parallel ends thereby forming an interior chamber, wherein at least one end is open and at least one end is adapted to be removably closed, wherein the interior chamber is adapted to receive and retain insulation, wherein the top panel further includes at least one extension flap on at least one of the top panel ends, wherein the at least one extension flap is adapted to communicate with one end of the bottom panel of the knee-wall door-insulation jacket, and wherein the at least one extension flap and the interior surface of the bottom panel include a communicating securement device for releasably securing the at least one extension flap to the bottom panel end. The cover further includes a closure device for removably securing the knee-wall door-insulation flange to the knee-wall door-insulation jacket.

The primary purpose of this invention is to create an insulator to cover access openings leading into scuttle-hole type attic spaces and vertical attic doors. Advantageously, the present invention is easy to install and fits tightly to ceiling joists, while having insulation contained in the top of the product to provide a higher R-value than other products on the market. The ability to add insulation directly in the cover device is also an advantage. Further, the cover sets closer inside the attic opening which keeps better thermal resistance on the sides or the perimeter. This promotes savings on heating and cooling.

The insulation cover works well in the winter and summer to provide energy savings. Further, the insulation cover creates an airtight seal around the attic access area thereby helping to prevent air leakage from the attic to the main part of a house and helps prevent the transmission of dust and other pollutants from coming into the living area of the house.

Another key advantage is convenience in packaging for storage and shipping. Because the expense of shipping an attic-insulation cover can be high, the present invention advantageously eliminates any major costs primarily because the material making up the attic-insulation cover of the present invention is primarily a flexible cloth-like material, which can be folded into a small package for storage and/or transport. The insulation does not necessarily have to be shipped, as insulation is prevalent at any hardware store or home store facility. When the attic-insulation cover arrives, it is a simple maneuver to unfold it for placement on a pull down ladder unit. If desired, insulation may then be obtained locally for insertion into the interior chamber of the insulation jacket.

Summarizing the advantages of the present invention, the insulation cover insulates and air seals attic access, is quickly and simply installed, provides easy zipper access to the attic, creates increased energy savings, is non-toxic, provide an excellent vapor barrier and superior thermal performance, is flexible and durable. The present invention can also be used in newly constructed buildings or retrofitted into an existing building.

The objects and advantages of the invention will appear more fully from the following detailed description of the preferred embodiment of the invention made in conjunction with the accompanying photographs.

DETAILED DESCRIPTION OF THE INVENTION

Figure 1:
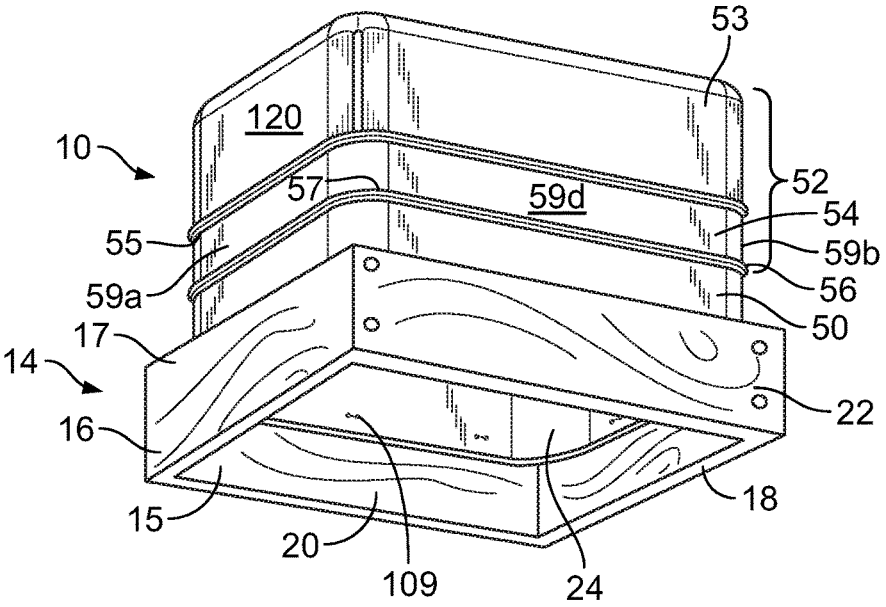
FIG. 1 is a perspective view of an attic insulation cover 10 of the present invention installed on an attic-opening frame 14.

With reference to FIG. 1, there is illustrated the attic-insulation cover device 10 of the present invention in combination with a standard attic-opening frame unit 14, known to the art for access to a building attic space 30 or the like.

Attic Opening Frame 14

Figure 4:
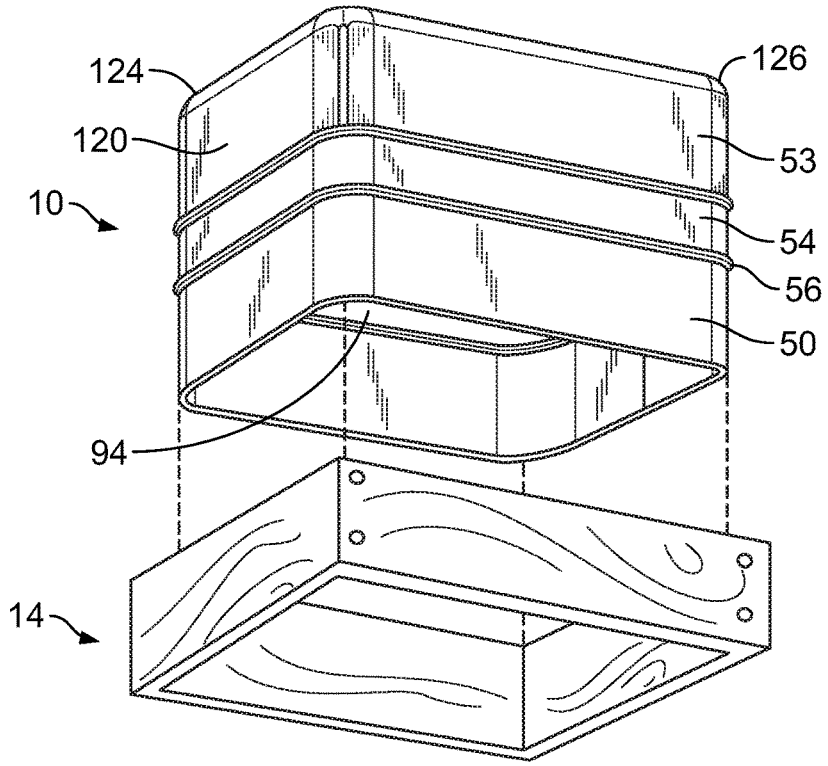
FIG. 4 is an exploded perspective view of the attic insulation cover 10 of FIG. 1 for placement on the attic-opening frame 14.

Referring to FIGS. 1 and 4, a typical attic-opening frame 14 has an interior surface 15 and an exterior surface 16, and generally consists of a square or rectangular framework of boards, typically 2"×10" boards, formed by spaced side walls or parallel opposing frame boards 17, 18 attached 10 to spaced side walls or parallel opposing frame boards 20, 22, surrounding the attic opening 24 to form the framework.

The frame 14 is typically built into the framework (not illustrated) of the attic space 30 in a manner known to the art. The attic opening 24 is cut from the ceiling 25 and a framework 27 of typically mitered frame boards 27*a*, 27*b*, 27*c* and 27*d* frame the opening 24 both for aesthetics and to provide a support for the cover panel 26 with a lip 28.

Attic-Insulation Cover 10

Figure 2:
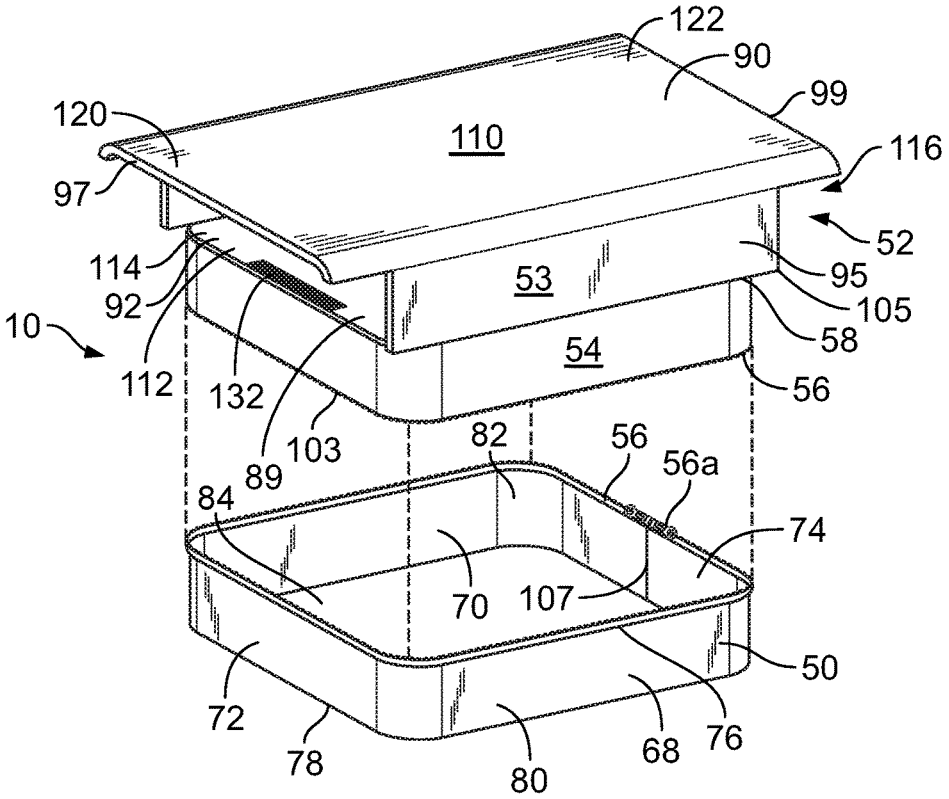
FIG. 2 is an exploded perspective view of the top portion of the attic insulation cover 10 of FIG. 1.

Referring now to FIGS. 1 and 2, the attic-insulation device 10 of the present invention is defined by two separable units, an attic insulation flange 50 or border and an insulation jacket 52, which is removably secured to the flange 50 by a connection or closure device 56, such as a zipper, hook and loop fastener, or the like. For purposes of describing the present invention, the closure device 56 will illustrated as a standard zipper.

Material for Constructing Attic-Insulation Cover 10

The material used for constructing the attic-insulation device 10 is preferably a thick, rip stop or non-tearing flexible material, such as canvas, heavy or rubberized cotton or the like. The preferred material is fire proof or at least fire resistant. A preferred material for use in the construction of the attic-insulation cover 10 is a flexible two-sided foil faced foam insulation with ¼" inch nominal thickness, such as that produced by Environmentally Safe Products, Inc. (New Oxford, Pa. 17350). When using the preferred wall material as described, the insulation capacity is increased by around nine Rs.

Attic Insulation Flange 50

Figure 5:
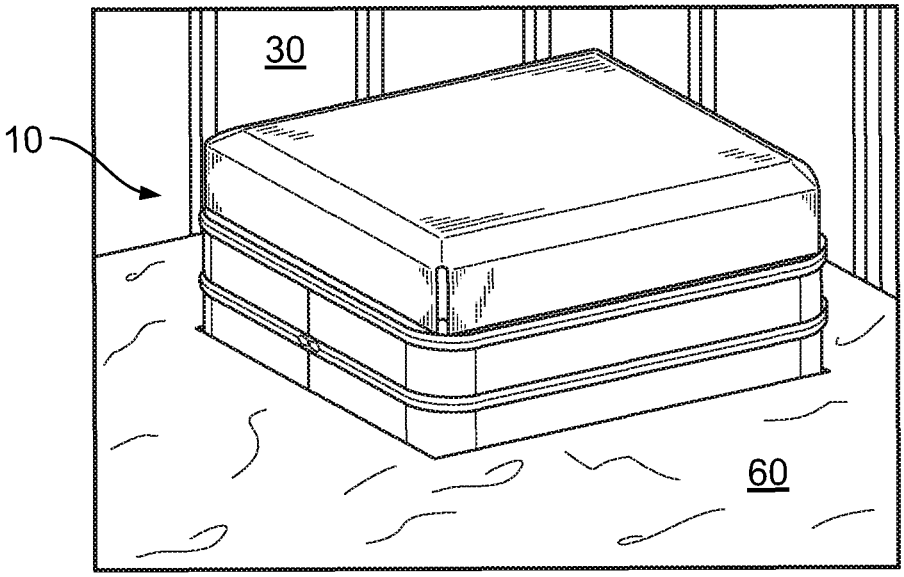
FIG. 5 is a perspective view illustrating the attic insulation cover 10 of FIG. 1 from the attic space 30.
Figure 9:
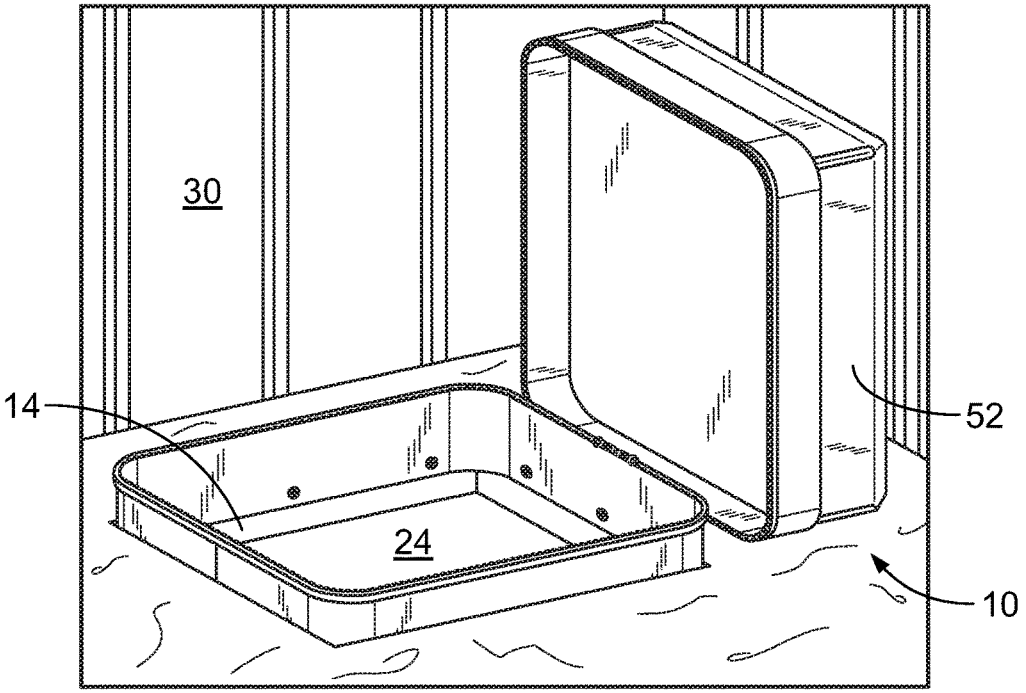
FIG. 9 is a perspective view of the attic insulation cover 10 of FIG. 5 with the attic insulation jacket 52 removed.

The attic insulation flange 50 is designed to fit within the attic-opening frame 14 and provides a border for attic insulation 60, illustrated in FIGS. 5 and 9, to abut to it.

The attic insulation flange 50 is defined by elongated parallel side walls 68, 70 connected to another pair of parallel side walls 72, 74. The flange 50 is bordered by a first upper end 76, a second lower end 78, an exterior surface 80 and an interior surface 82 defining the flange opening 84. As illustrated in FIGS. 1-4, the first upper end 76 is defined by the closure device 56. The flange 50 is designed to fit within the interior surface 15 of the frame 14 in a generally snug fit relationship to minimize air leakage from the attic space 30, as illustrated in FIG. 1.

Figure 3:
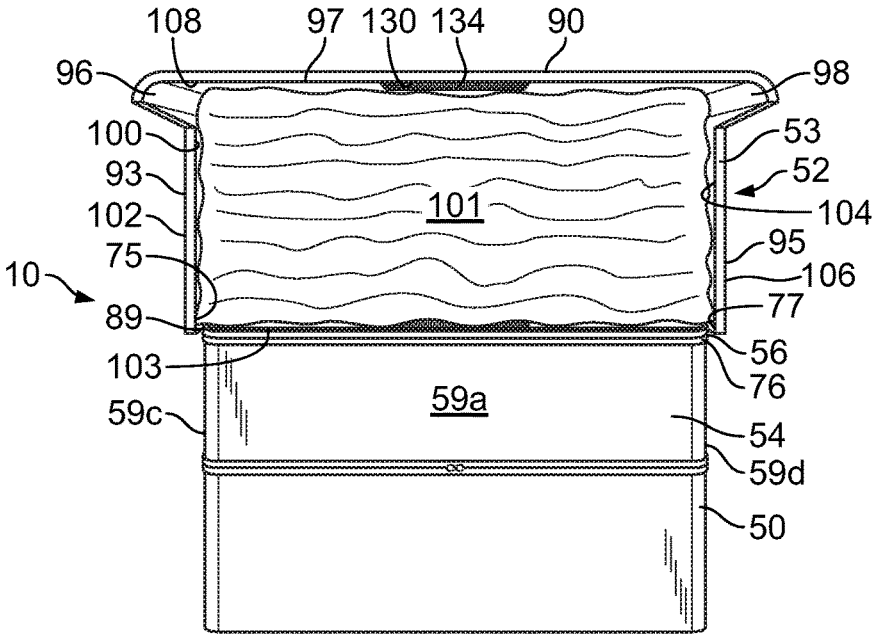
FIG. 3 is an end view of the top portion of the attic insulation cover 10 of FIG. 2 illustrating one open end with insulation 101.

The top panel 90 connects to side panels 93, 95 at edges 96, 98 and includes ends 97, 99. The connected panels 89, 90, 93 and 95 form an interior chamber 112 with openings 114 and 116 at either end of the attic insulation jacket 52. The interior chamber 112 is designed to receive insulation 101 as illustrated in FIG. 3 and as will be described further on. Accordingly, the sidewalls 93, 95 are preferably between about 7 and 15 inches high such that the interior chamber 112 can accommodate the insulation 101.

The top panel 90 further includes at least one and preferably two flexible extension flaps 120, 122 on either end 97, 99 of the top panel 90. As illustrated in FIGS. 1 and 4, the extension flaps 120, 122 are designed to fold forming creases 124, 126 such that the ends 97, 99 of the extension flaps 120, 122 will come into communication with the ends 103, 105 of the separation panel 89.

As illustrated in FIGS. 3 and 4, a securement device 130 is provided for adhering the ends 97, 99 to ends 103, 105 respectively. As illustrated in the drawings, the securement device 130 is preferably releasable, such as a co-acting hook and loop, i.e., VELCRO connector. However, the securement device 130 can also be snaps, buttons, staples, zippers, needle and thread or any other type of device known for securing the ends together. If desired, the insulation chamber 53 can be permanently closed at one end, leaving the other end open to receive the insulation 101. For purposes of illustration, the securement device 130 is of the hook and loop or VELCRO variety, having a first securing piece 132 attached, by glue, stitching or other means, to ends 103, 105 of the bottom panel 89 of the insulation chamber 53. A second securing piece 134 is attached to the ends 97, 99 of the extension flaps 120, 122 on the interior surface 108 of the top panel 90. To close off the interior chamber 112 of the insulation chamber 53, the extension flaps 120, 122 are creased and bent at edges 124, 126 such that the ends 97, 99 of the extension flaps 120, 122 come into contact with the ends 103, 105 of the bottom panel 89 to allowed the securing pieces 132, 134 to releasably connect.

As discussed above, the attic insulation jacket 52 is further defined by a bridge section 54 connected at its upper end 55 to the separation panel 89 of the insulation chamber 53 forming a seam 58 therebetween. The bridge section 54 includes a lower end 57 and two sets of connected parallel walls 59*a*, 59*b*, 59*c* and 59*d*. The combination of the parallel walls 59*a*-59*d* and upper panel 94 (the exterior surface of the separation panel 89) forms a panel pocket 61 for purposes of placement of the cover panel 26 when the insulation device 10 is opened for access into the attic space 30.

Insulation 101

Once the insulation chamber 53 is constructed, insulation 101 is preferably installed within the interior chamber 112 of the insulation chamber 53, as illustrated in FIG. 3. While there are a variety of forms of insulation 101 for placement within the interior surface 100, a preferred form is a standard "batt" of insulation 101 known to the art. The interior chamber 112, illustrated in FIG. 3, is preferably designed to accommodate a standard batt of insulation 101, having standard dimensions of approximately three feet wide and one foot high. The length of the batt of insulation 101 can be cut to accommodate the length of the insulation chamber 53. Typical batt of insulation 101 will have an R-38 insulation factor although the insulation chamber 53 can hold insulation having an R-49 factor or more.

The extension flaps 120, 122 of the top panel 90 are then secured as described above to retain the insulation 101 within the interior chamber 112 of the attic insulation jacket. While insulation 101 is not required to be placed within the interior of the insulation jacket, it is desired to do so in order to enhance the insulation ability of the pulldown ladder jacket 12.

Construction of the Attic-Insulation Cover 10

As described previously, the wall material is preferably made of 2-sided foil faced foam insulation with ¼" inch nominal thickness. The preferred material is produced by Environmentally Safe Products, Inc. (New Oxford, Pa. 17350). Other fabric material, such as canvas, cotton and other preferably heavy grade materials can also be used for this invention. It is especially preferred that the material be flexible and foldable for ease of storage when not in use and ease of packing for shipment.

The closure device 56 is preferably a nylon coil zipper, typically a 5-gauge 1-inch zipper and made of 100% polyester, catalog #688, manufactured by Lenzip Manufacturing Corporation (Rolling Meadows, Ill.). Non-lock long pull #5 gauge sliders catalog #487 are attached to the zipper coil. Although zippers are the preferred closure device, it is within the scope to use other connectors, such as hook and loop (VELCRO) fasteners and the like.

The attic-insulation cover 10 is preferably constructed by a sewing machine using T-60 Edd core PCP black nylon thread T/II AA50199 (Eddington Thread Manufacturing, Bensalem, Pa.). The hook and loop fasteners are preferably 1-inch wide industrial strength VELCRO strips, model #624 (Velcro USA, Inc., Manchester, N.H.).

A preferred process for manufacturing the attic-insulation cover 10 of the present invention uses the following steps:

- Cut off a piece of 1-inch coil zipper, 12 feet long and attach two of the non-locking zipper sliders on the zipper; the noses of each slider must be facing each other once in place.
- Cut 1 piece of the 10-inch foil-faced foam insulation at thirteen feet.
- Get a sheet of 24" by 55" piece of foam insulation.
- Sew one-half of the piece of coil zipper around the perimeter of the sheeted piece of foam insulation.
- Take the 10" piece of foil-faced foam insulation and sew the other half of the coil zipper around one side of that piece which forms the bottom part or the flange of the jacket.
- Take a 42"×68" oversized piece of sheeted insulation, i.e., the top panel 90 and sew it to the 24"×55" piece (the bottom panel 89) on the long sides only. Once sewn together, this creates the attic insulation jacket 52, which forms the interior chamber 112 to receive the insulation 101.
- As the top panel 90 is around 13" longer than the bottom panel 89, this results in a 6½" overlap on the ends 97, 99, the extension flaps 120, 122, to fold down and close off interior chamber 112 once the insulation 101 is inserted to prevent loss of the insulation 101.
- To create the securement device 130, a piece of approximately 6" hook and loop (VELCRO) adhesive strip is placed on the interior surface 108 of the top panel 90 at both ends 97, 99. The mating pieces of hook and loop adhesive strips are then adhered to the interior surface 92 of the bottom panel 89 at ends 103, 105.

Figure 6:
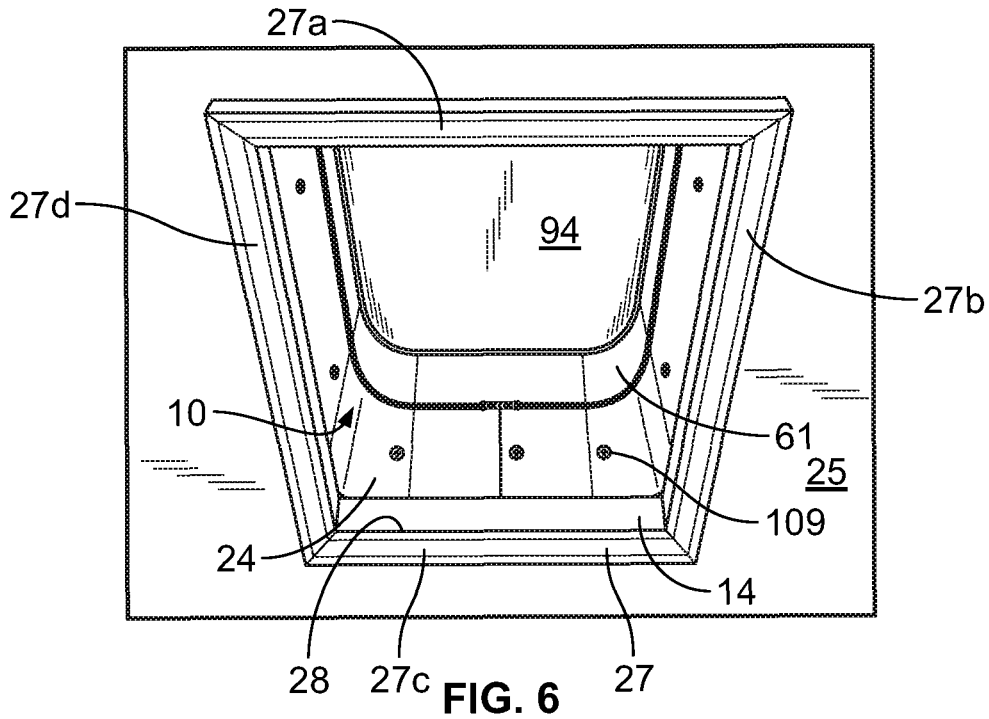
FIG. 6 is a bottom perspective view of the attic insulation cover 10 of FIG. 1 installed on the attic-opening frame 14.
Figure 7:
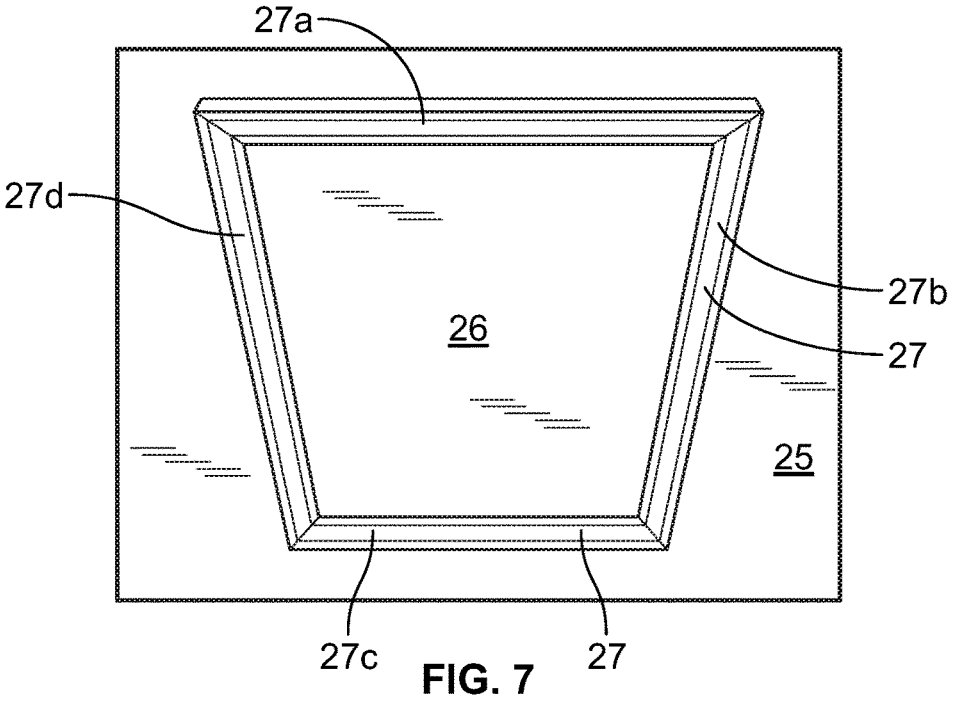
FIG. 7 is a bottom perspective view illustrating the attic-opening framework 27 in a ceiling 25 with a cover panel 26 in place.
Figure 8:
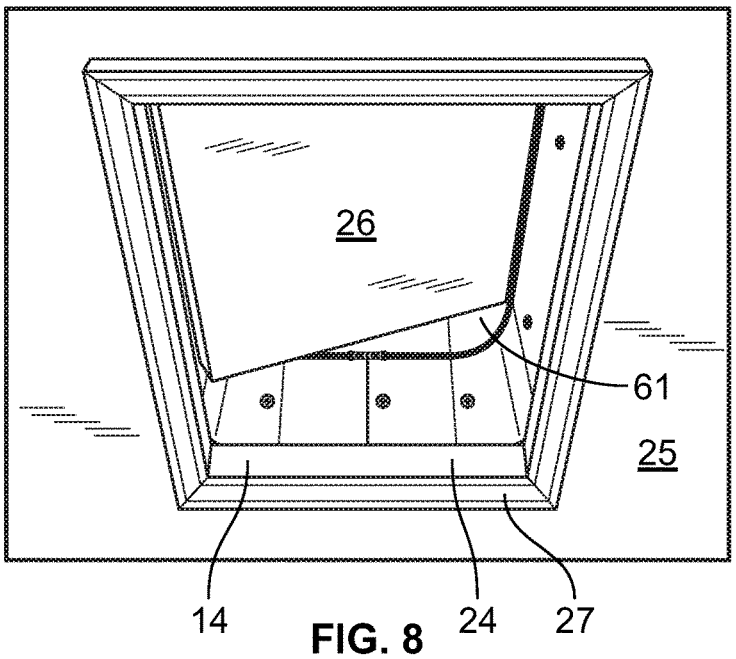
FIG. 8 is a bottom perspective view of the attic-opening framework 27 of FIG. 7 illustrating the cover panel 26 being elevated into the panel pocket 61 of the attic insulation cover 10.

Once the pulldown ladder jacket 52 is fully constructed, it is now ready to be attached to the attic-opening frame 14 of the pulldown ladder unit 12, as illustrated in FIGS. 7-9. Alternatively and preferably, a batt of insulation 101 is installed within the interior chamber 112 of the insulation jacket 52, as illustrated in FIGS. 4A, 5 and 6.

The extension flaps 120, 122 on the top panel 90 of the insulation jacket 52 are then creased at lines 124, 126 and folded downwardly such that the first securing pieces 132 on the ends 97, 99 of the top panel 90 meet the second securing pieces 134 on the ends 103, 105 of the bottom panel 89, as illustrated in FIGS. 5-6.

Installation of the Attic-Insulation Cover 10 on the Attic Opening Frame 14

One distinct advantage of the attic-insulation cover 10 of the present invention is the ease of installation. The attic-insulation cover 10 itself is relatively light, flexible and typically weighs less than about 20 pounds even with the insulation 101 installed within the interior chamber 112 of the insulation chamber 53. In addition, the material making up the attic-insulation cover 10 is flexible thereby allowing the device 10 itself to be easily transported and manipulated during installation.

While the attic-insulation cover 10 as described above is preferably designed for installation on an attic opening frame 14 having a 3 foot opening, it is within the scope of the present invention to adjust the dimensions of the attic-insulation cover 10 to meet the specifications of attic openings 24 of any dimension.

Once the attic-insulation cover 10 has been prepared, it is now ready for installation as illustrated in FIG. 4. With reference to FIGS. 4 and 6, the attic-insulation cover 10 is positioned such that the flange 50 is fitted within the interior of the frame 14, as illustrated in FIG. 6. As an added advantage of the installation of the flange 50 in this manner, the flange 50 eliminates the need for a weather stripping frame because the flange 50 itself acts as a weather strip. As illustrated in FIG. 2, the flange 50 preferably includes an open, overlapping section at seam 107 to assist in the positioning of the flange 50 with respect to the frame 14.

Once the flange 50 has been installed, the flange can be secured to the frame 14 by securing devices known to the art, such as staples (illustrated in FIG. 1), nails (illustrated in FIG. 6) or glue. Once the flange 50 has been secured to the frame 14, a caulking material can be applied to the gap between the flange 50 and the frame 14 to prevent further loss of heat or cool air.

FIG. 6 is a bottom perspective view of the attic insulation device 10 of FIG. 1 illustrating the device 10 attached to the frame 14 of the ceiling 25. As illustrated, the flange 50, the bridge section 54 with the panel pocket 61 and the exterior surface 94 of the bottom panel 89 of the insulation chamber 53 are visible. The insulation jacket 12 is secured to the flange 50 by means of the closure device 56, i.e., a zipper extending around the perimeter of the insulation jacket 12.

As illustrated in FIGS. 1 and 6-9, the attic-insulation device 10 is ready to use either to insulate the attic opening 24 or to allow access to the attic space 30. To access the attic space 30, the cover panel 26 is elevated by an operator (not illustrated) from the lip 28 of the framework 27 on the ceiling 25 and temporarily held in place in cover panel pocket 61, as illustrated in FIG. 8. This action exposes the closure device 56, which is then separated. If a zipper is used, the zipper is separated by pulling the zipper pulls 56*a* thereby separating the insulation jacket 52 from the flange 50, as illustrated in FIG. 9, to lift the insulation jacket 52 from the flange 50 for access to the attic space 30. Reattaching the insulation jacket 52 to the flange 50 to close off the attic opening 24 is an easy procedure, which essentially reverses the steps described above with respect to gaining access to the attic space 30.

Figure 10:
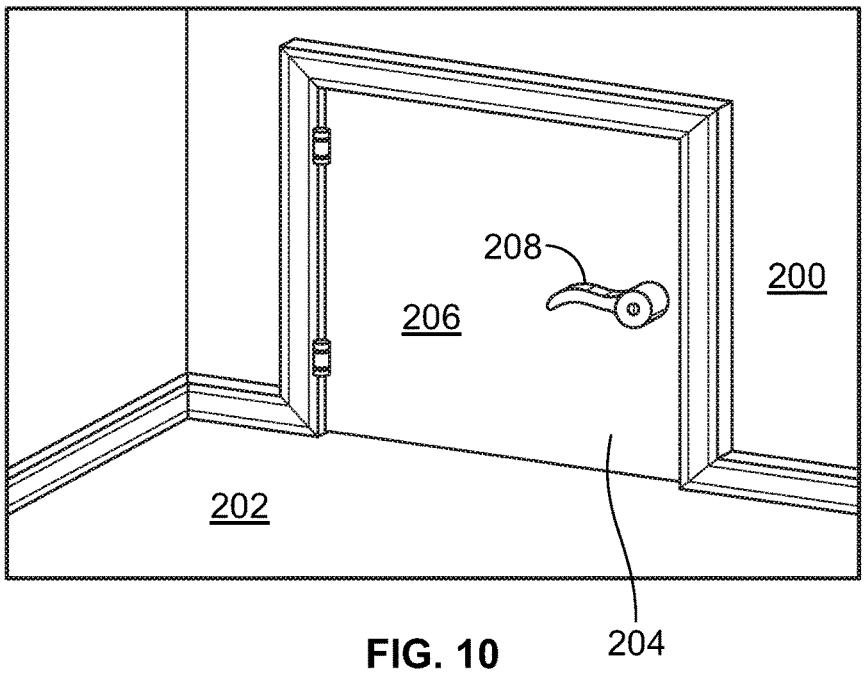
FIG. 10 is a perspective view illustrating a knee-wall door opening 204 with the knee-wall door 206 closed.
Figure 11:
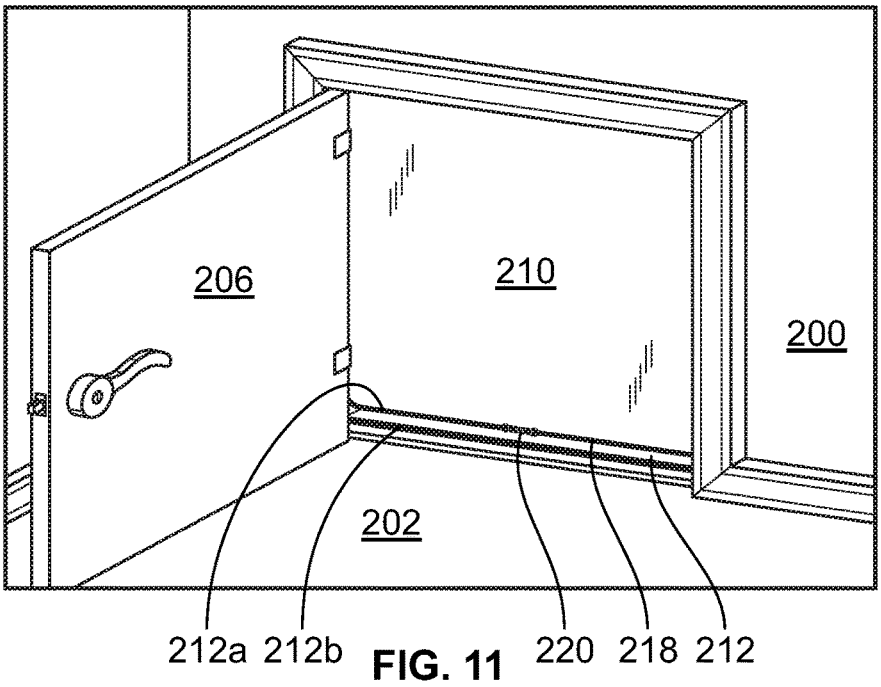
FIG. 11 is a perspective view illustrating a knee-wall door opening 204 of FIG. 10 with the knee-wall door 206 open and further illustrating a closed knee-wall insulation device 210.
Figure 12:
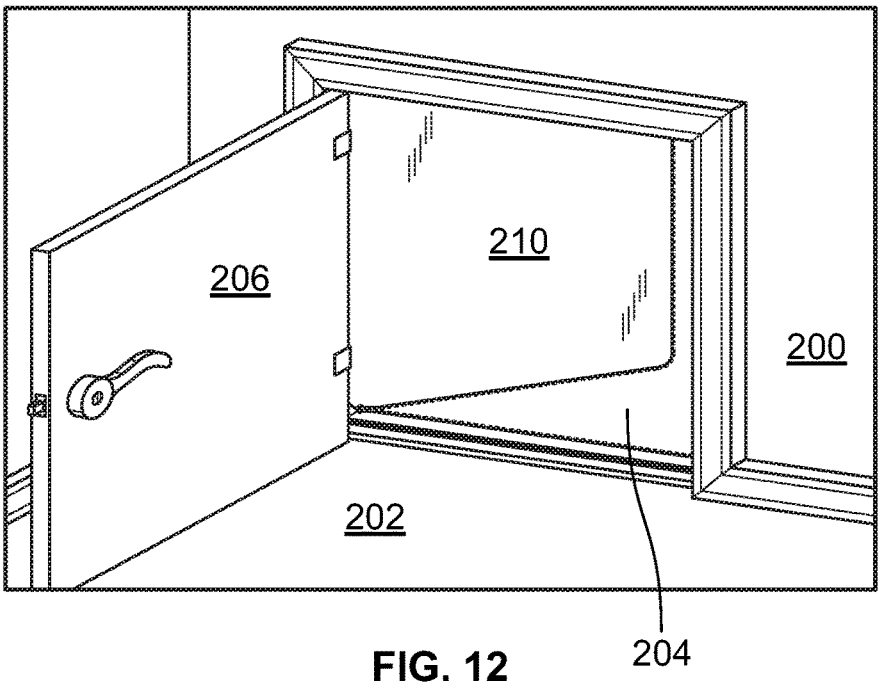
FIG. 12 is a perspective view illustrating the knee-wall door opening 204 of FIG. 11 with the door 206 open and further illustrating an open knee-wall door insulation device 210.

Reference is now made to FIGS. 10-12 for a second embodiment of the present invention directed to a knee wall jacket. As illustrated in FIGS. 10-12, an attic knee wall is typically a short vertical wall 200 that extends from the floor 202 probably to the roof rafters (not illustrated). Therefore, the knee wall opening 204 is effectively a crawl space opening for a user to access the attic. The knee wall opening 204 is cut out of the wall 200 and covered by a hinged knee wall door 206, typically having a handle 208 to latch the door.

In order to provide enhanced insulation and loss of heat in the winter and cool air in the summer, the knee wall opening 204 can be provided with a knee wall insulation device 210, which is similar to the attic insulation device 10, described above. However, the knee wall insulation device 210 is vertically oriented. Like the attic insulation device 10, the knee wall insulation device 210 includes a door-insulation flange 212, which is similarly attached to square or rectangular framework 214 of the knee wall opening 204. The flange 212 has a first end 212*a* and a second end 212*b* where the second end 212*b* is defined a closure device 218. Unlike the attic insulation device 10 of the present invention, there is no need for a bridge section 54 as there is no need for a separate cover panel 26. In this manner, the knee wall insulation device 210 operates in a similar manner to the insulation device described and claimed in applicant's parent U.S. application Ser. No. 15/337,065, which is incorporated herein by reference in its entirety.

The knee-wall insulation device 210 comprises a bottom panel and a top panel, parallel sidewall panels and parallel ends thereby forming an interior chamber. While not disclosed in the drawings, they are identical to that described and disclosed with respect to the insulation device 10 described previously. At least one end of the device 210 can be open and adapted to be removably closed. The interior chamber is adapted to receive and retain insulation as described previously. The top panel further includes at least one extension flap on at least one of the top panel ends. The extension flap is adapted to communicate with one end of the bottom panel of the knee-wall door-insulation jacket. The extension flap and the interior surface of the bottom panel include a communicating securement device for releasably securing the extension flap to the bottom panel end. For purpose of this description, the closure device 218 is illustrated as a zipper with a zipper pull 220.

Figure 13:
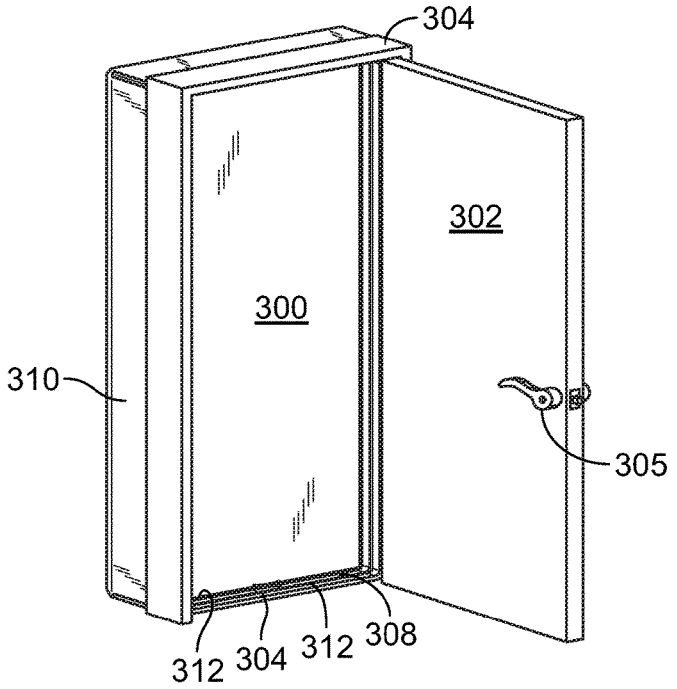
FIG. 13 is a perspective view of a full-sized attic door 302 with door 302 open and further illustrating a closed attic-door insulation cover 300.
Figure 14:
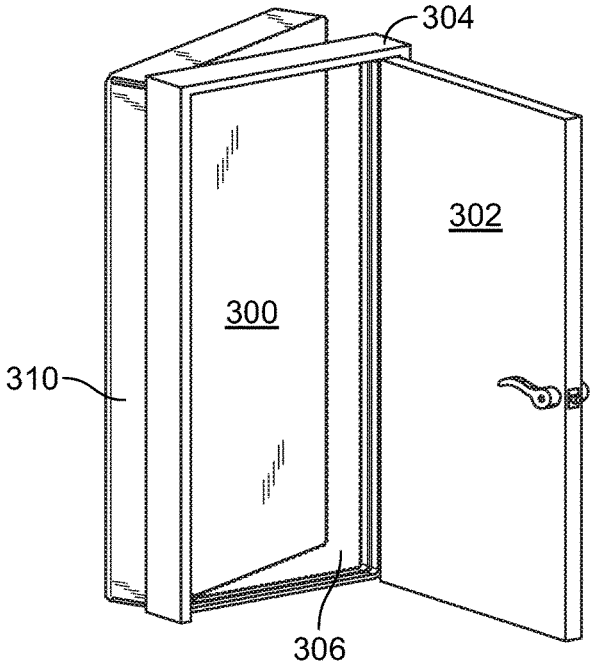
FIG. 14 is a perspective view of a full-sized attic door 302 of FIG. 13 with the door 302 open and further illustrating an open attic-door insulation cover 310.

Reference is further made to FIGS. 13-14 for a third embodiment of the present invention directed to a full-sized door jacket 300, which will insulate a full-sized door 302. As illustrated in FIGS. 13 and 14, the door 302 and the accompanying door frame 304 provides a standard size door opening 306 sufficient to enable a typical human to walk through the opening 306 without the need to stoop. The door 302 can be for an attic entrance. However, the door 302 can also be used for any door entrance, such as a garage entrance. The door 302 typically has a handle 305 to latch the door 302.

In order to provide enhanced insulation and loss of heat in the winter and cool air in the summer, the door opening 306 can be provided with a door jacket or insulation device 300, which again is similar to the attic insulation device 10, described above. Like the knee wall door insulation device 210, the door jacket 300 is vertically oriented. The door jacket 300 further includes a flange 308, which is similarly attached to the rectangular framework 304 of the door opening 306. Similar to the knee wall insulation device 210, there is no need for a bridge section 54 as there is no need for a separate cover panel 26. In this manner, the door jacket 300 operates in a similar manner to the insulation device described and claimed in applicant's parent U.S. application Ser. No. 15/337,065, which is incorporated herein by reference in its entirety. The door jacket 300 includes a door insulation jacket 310, which is attached to the flange 308 by a closure device 312. For purpose of this description, the closure device is illustrated as a zipper with a zipper pull 314. Reference is made to the description of the insulation chamber 53 for a description of the door jacket 300. Like the insulation chamber 53, the door jacket also includes an insulation chamber 314, which can accept a batt of insulation.

Any version of any component or method step of the invention may be used with any other component or method step of the invention. The elements described herein can be used in any combination whether explicitly described or not.

All combinations of method steps as used herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, and peer-reviewed publications (i.e., "references") cited herein are expressly incorporated by reference in their entirety to the same extent as if each individual reference were specifically and individually indicated as being incorporated by reference. In case of conflict between the present disclosure and the incorporated references, the present disclosure controls.

The devices, methods, compounds and compositions of the present invention can comprise, consist of, or consist essentially of the essential elements and limitations described herein, as well as any additional or optional steps, ingredients, components, or limitations described herein or otherwise useful in the art.

While this invention may be embodied in many forms, what is described in detail herein is a specific preferred embodiment of the invention. The present disclosure is an exemplification of the principles of the invention is not intended to limit the invention to the particular embodiments illustrated. It is to be understood that this invention is not limited to the particular examples, process steps, and materials disclosed herein as such process steps and materials may vary somewhat. It is also understood that the terminology used herein is used for the purpose of describing particular embodiments only and is not intended to be limiting since the scope of the present invention will be limited to only the appended claims and equivalents thereof.

What is claimed is:

1. An attic-insulation cover for insulating an opening in a ceiling, wherein the opening includes an attic-opening frame having spaced side walls and spaced end walls and a removable cover panel, the attic-insulation cover comprising:

a. an attic insulation flange adapted to be secured to the attic-opening frame;

b. a panel pocket adapted to temporarily receive the removable cover panel, wherein the panel pocket comprises parallel sidewalls and an upper panel to form a recessed area for receiving the removable cover panel, wherein the panel pocket is removably secured to the attic insulation flange, c. an attic-insulation chamber, wherein the attic-insulation chamber is secured to the panel pocket, wherein the attic-insulation chamber comprises a bottom panel and a top panel, parallel sidewall panels and parallel ends, wherein one end is open and at least one end is adapted to be removably closed, thereby forming an interior chamber; and d. a closure device for removably securing the attic-insulation flange to the panel pocket.

2. The attic-insulation cover of claim 1 wherein the closure device is selected from the group consisting of a zipper and a hook and loop fastener.

3. The attic-insulation cover of claim 1 wherein the closure device is a zipper.

4. The attic-insulation cover of claim 1, wherein the wherein the top panel of the attic-insulation chamber further includes at least one extension flap on at least one of the top panel ends, wherein the at least one extension flap is adapted to communicate with at least one end of the bottom panel of the attic-insulation chamber.

5. The attic-insulation cover of claim 1, wherein the attic-insulation flange has a first upper end and a second lower end, wherein the first upper end is defined by the closure device.

6. The attic-insulation cover of claim 1, wherein the insulation chamber is adapted to receive and retain insulation.

7. The attic-insulation cover of claim 6, wherein the insulation is a batt of insulation sized to fit within the interior chamber of the attic-insulation chamber.

8. A door-insulation cover, for insulating a door opening, wherein the opening includes a door frame having spaced side walls and spaced end walls and a door, the door-insulation cover comprising:

a. a door insulation flange adapted to be secured to the door frame;

b. a door-insulation jacket, wherein the door-insulation jacket is removably secured to the door-insulation flange, wherein the door-insulation jacket comprises a first panel and a second panel, parallel sidewall panels and parallel ends, wherein one end is open and at least one end is adapted to be removably closed, thereby forming an insulation chamber; and c. a closure device for removably securing the door-insulation flange to the door-insulation jacket.

9. The door-insulation cover of claim 8, wherein the top panel extension flap and the interior surface of the first panel include a communicating securement device for releasably securing the at least one second panel extension flap to the first panel end.

10. The door-insulation cover of claim 9, wherein the securement device is a hook and loop connector.

11. The door-insulation cover of claim 9, wherein both ends of the door-insulation jacket are open for receiving insulation.

12. The door-insulation cover of claim 8, wherein the door-insulation cover is comprised of insulated wall material.

13. A vertical door-insulation cover for insulating a vertical door opening, wherein the door opening includes a door frame having spaced side walls and spaced end walls, the door-insulation cover comprising:

a. a door insulation flange adapted to be secured to the door-opening frame, wherein the door-insulation flange has a first end and a second end, wherein the first end is defined by a closure device;

b. a door-insulation jacket, i. wherein the door-insulation jacket is removably secured to the door-insulation flange, ii. wherein the door-insulation jacket comprises a bottom panel and a top panel, parallel sidewall panels and parallel ends thereby forming an interior chamber, iii. wherein at least one end is open and at least one end is adapted to be removably closed, wherein the interior chamber is adapted to receive and retain insulation, iv. wherein the top panel further includes at least one extension flap on at least one of the top panel ends, v. wherein the at least one extension flap is adapted to communicate with one end of the bottom panel of the knee-wall door-insulation jacket, and vi. wherein the at least one extension flap and the interior surface of the bottom panel include a communicating securement device for releasably securing the at least one extension flap to the bottom panel end; and c. a closure device for removably securing the knee-wall door-insulation flange to the knee-wall door-insulation jacket.

14. The vertical door insulation cover of claim 13, wherein the door is a knee wall door.

15. The door-insulation cover of claim 13 wherein the closure device is selected from the group consisting of a zipper and a hook and loop fastener.

16. The door-insulation cover of claim 13 wherein the closure device is a zipper.

17. The door-insulation cover of claim 13, wherein the insulation is a batt of insulation sized to fit within the interior chamber of the door-insulation jacket.

18. The door-insulation cover of claim 13, wherein the securement device is a hook and loop connector.

19. The door-insulation cover of claim 13, wherein both ends of the door-insulation jacket are open for receiving insulation.

20. The door-insulation cover of claim 13, wherein the door-insulation cover is comprised of insulated wall material.

* * * * *